US007079665B2

(12) United States Patent
Shimomura et al.

(10) Patent No.: US 7,079,665 B2
(45) Date of Patent: Jul. 18, 2006

(54) LOUDSPEAKER

(75) Inventors: Katsuya Shimomura, Mie (JP); Shinsaku Sawa, Mie (JP); Shuji Ido, Osaka (JP); Shigeru Nishida, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 511 days.

(21) Appl. No.: 09/950,060

(22) Filed: Sep. 12, 2001

(65) Prior Publication Data

US 2002/0044671 A1 Apr. 18, 2002

(51) Int. Cl.
*H04R 25/00* (2006.01)

(52) U.S. Cl. ..... 381/433; 381/396; 381/397; 381/420

(58) Field of Classification Search ..... 381/396, 381/397, 407, 412, 419, 420, 433, FOR. 154, 381/FOR. 159; 181/148
See application file for complete search history.

(56) References Cited

U.S. PATENT DOCUMENTS 2,295,483 A * 9/1942 Knowles ..... 381/404
3,176,086 A * 3/1965 Coen ..... 381/433
3,991,286 A * 11/1976 Henricksen ..... 381/189
5,111,510 A * 5/1992 Mitobe ..... 381/398
5,940,522 A * 8/1999 Cahill et al. ..... 381/397
6,373,957 B1 * 4/2002 Stewart ..... 381/397

FOREIGN PATENT DOCUMENTS

JP 0121613 * 10/1978 ..... 381/FOR. 154

* cited by examiner

*Primary Examiner*—Huyen Le
(74) *Attorney, Agent, or Firm*—Wenderoth, Lind & Ponack, L.L.P.

(57) ABSTRACT

A loudspeaker has a magnetic circuit, a plastic frame to be coupled with the magnetic circuit, a voice coil disposed in a magnetic gap of the magnetic circuit, and a diaphragm connected with the voice coil. The frame and the magnetic circuit are coupled together by an elastic fastener provided on the frame. The frame and yoke are coupled together by fitting a plurality of elastic fasteners provided on a circle on a bottom surface of the frame with a yoke of the magnetic circuit. The elastic fastener can also be a clip section provided on a circle on the bottom surface of the frame. The frame and magnetic circuit are coupled together by the clip section and an extension provided along an outer circumference of the magnetic circuit.

17 Claims, 7 Drawing Sheets

FIG.3A
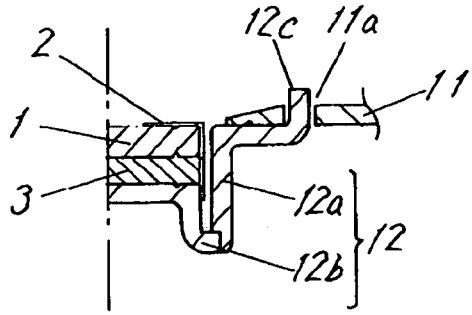
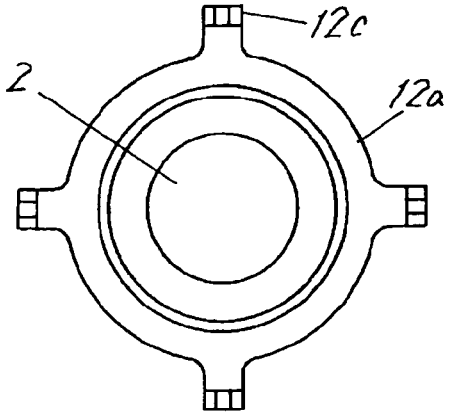
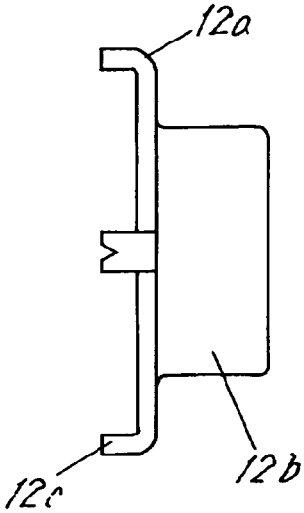
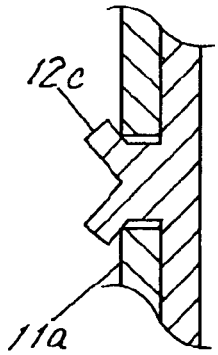
FIG.3B FIG.3C FIG.3D

LOUDSPEAKER

FIELD OF THE INVENTION

The present invention relates to a loudspeaker for use in car-borne audio equipment and the like.

BACKGROUND OF THE INVENTION

A conventional loudspeaker is described referring to FIG. 9, a conventional loudspeaker comprises a magnetic circuit A consisting of a magnet 1, a top plate 2, a bottom plate 3 and a yoke 4. The loudspeaker also comprises a voice coil 5 provided in the gap of the magnetic circuit A, a frame 6, a diaphragm 7, and a damper 8.

The magnetic circuit A is fixed to the frame 6 by inserting a plurality of protrusions 4*a* provided at the outer edge of yoke 4 into a plurality of fixing holes 6*a* provided in the frame 6, and caulking, or swaging, them.

Many of the recent car-borne audio equipment are also boasting of a greater output in their compact overall dimensions. With an aim to make the magnetic circuit A of a speaker small and compact, a magnet of neodymium, which has a higher magnetic energy as compared with conventional ferrite magnets, is increasingly used for the magnet 1. This requires subtle work during assembly of a loudspeaker in connecting the magnetic circuit A with the frame 6.

SUMMARY OF THE INVENTION

A loudspeaker of the present invention comprises a magnetic circuit, a plastic frame to be connected with the magnetic circuit, a voice coil disposed in a magnetic gap of the magnetic circuit, and a diaphragm coupled to the voice coil. In the loudspeaker, the frame and the magnetic circuit are connected together by means of an elastic fastener provided on the frame.

In an example of a loudspeaker in accordance with an exemplary embodiment of the present invention, the frame and yoke are connected together by fitting a plurality of elastic fasteners provided on a circle of a bottom surface of the frame to the yoke.

In another exemplary embodiment of the present invention, the elastic fastener is a clip provided on a circle of the bottom of the frame. The frame and the magnetic circuit are connected together by means of the clips and expansions provided along the outer circumference of the magnetic circuit.

BRIEF DESCRIPTION OF THE DRAWINGS

FIG. 3A is a cross sectional view showing a magnetic circuit of another loudspeaker in accordance with the first exemplary embodiment of the present invention.

FIG. 3B is a plan view of the yoke.

FIG. 3C is a side view of the another loudspeaker in the first exemplary embodiment of the present invention.

FIG. 3D is a cross sectional view showing a magnified caulked portion.

DESCRIPTION OF THE PREFERRED EMBODIMENTS

Figure 1:
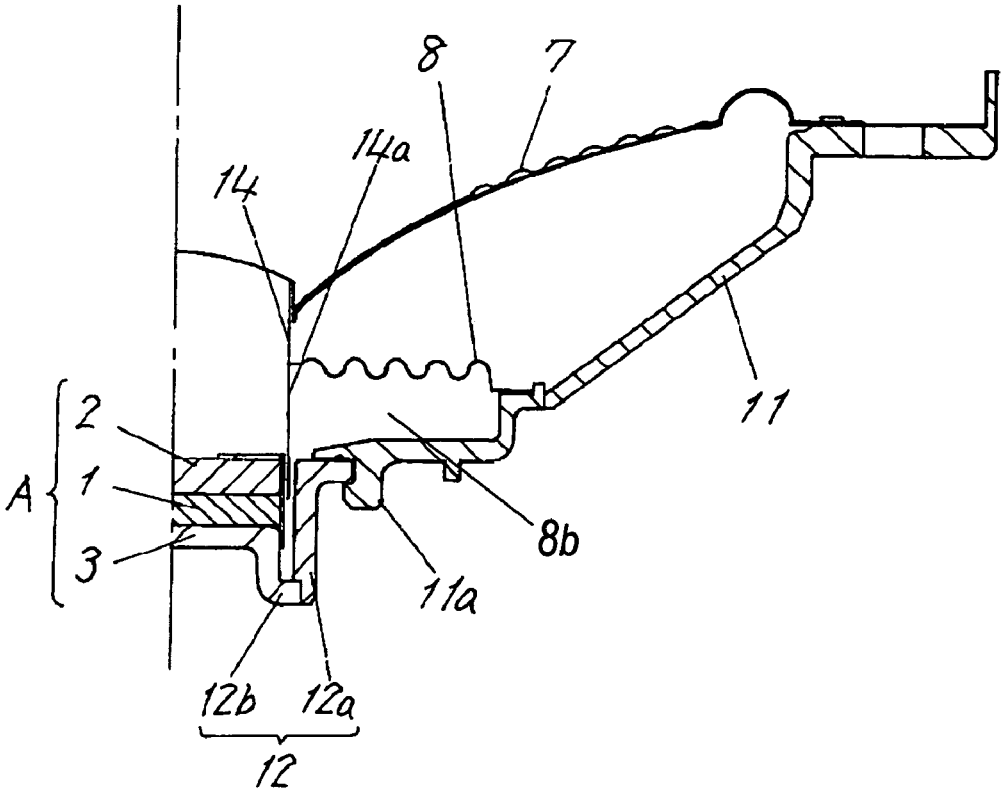
FIG. 1 is a cross sectional view of half of a loudspeaker in accordance with a first exemplary embodiment of the present invention.

A loudspeaker in accordance an exemplary embodiment of the present invention is described in the following with reference to FIG. 1 through FIG. 8. Elements similar to those in the conventional technology have the same reference numerals, and the descriptions of those elements are omitted.

First Embodiment

A loudspeaker in a first exemplary embodiment of the present invention is described with reference to FIG. 1 and FIG. 2. Description is made on the differences with the conventional loudspeakers.

The loudspeaker of the present embodiment comprises a voice coil 14 having an air ventilation hole 14*a*, a plastic frame 11, a plurality of elastic fasteners 11*a* provided at the vicinity of an inner circumference of the frame 11, an outer cylindrical portion 12*a* of a yoke 12, the outer cylindrical portion 12*a* designed to engage at its outer circumference with the elastic fastener 11*a*, and a bottom portion 12*b* connected at its outer circumference with the outer cylindrical portion 12*a*. In addition, a single elastic fastener 11*a* could be used. The yoke 12 comprises the outer cylindrical portion 12*a* and the bottom portion 12*b*. Thus, the loudspeaker of the present embodiment has an inner magnet type magnetic circuit.

Figure 2:
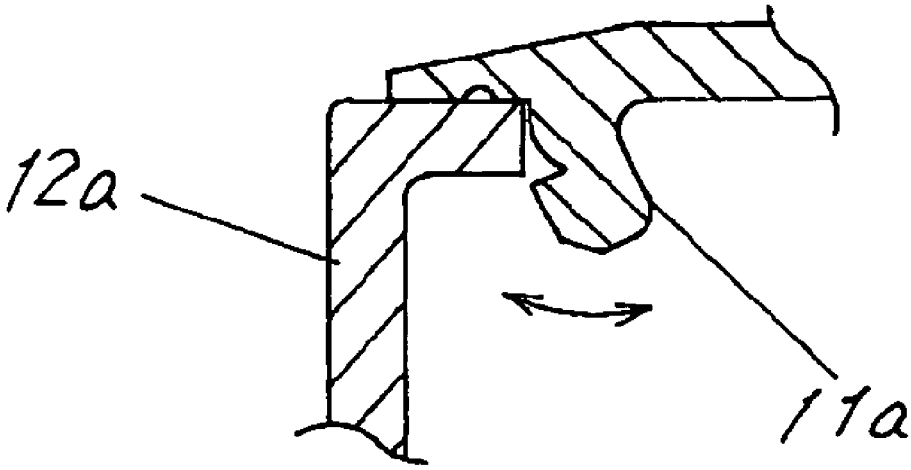
FIG. 2 is a magnified cross sectional view, in part, used for describing how a yoke and a frame are connected.

In a loudspeaker of the present embodiment configured as above, the frame 11 and the yoke 12 are fastened together through a snap-in action, by deforming the elastic fastener 11*a* with the outer circumference of the yoke 12, as illustrated in FIG. 2. In this way, the yoke 12 and the frame 11 can be fastened together through a quite easy operation.

A firm and rigid bonding can be established if an adhesive material is applied around the outer circumference of the yoke 12 and the inner circumference of the frame 11.

In the above case, the elastic fastener 11*a* works also as a temporary holding member, and the assembly operation for a loudspeaker unit can proceed without needing any consideration of the time required for the adhesive material to hardened.

Furthermore, since the yoke 12 of the loudspeaker in the present embodiment is formed of a component split into two units, there is no need for deep-drawing work of a metal sheet when manufacturing the yoke 12. This contributes to an improved productivity during the production of the yoke 12.

Even in a case where the frame 11 is manufactured with a material other than plastic material, a similar advantage of an improved productivity can be obtained by providing a yoke 12 alone with the configuration in which the component is split into two units. In this case, the yoke 12 is provided at the outer circumference edge with a caulking portion 12*c* as shown in FIG. 3. Then, the yoke 12 can be connected with the frame 11 by inserting the caulking portion 12*c* through a hole 11*a* in the frame 11*f* and expanding the caulking portion 12*c* inside the hole 11*f*. The outer cylindrical portion 12*a* of yoke 12 can be formed using a thin metal sheet.

Next, a structure of the yoke 12, where the component has been split into two units for forming the yoke, is described more in detail.

Figure 4A:
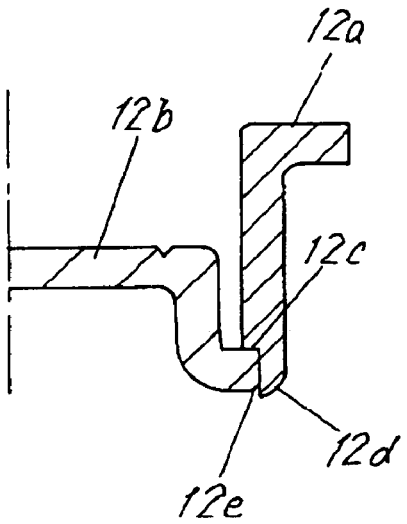
FIG. 4A is a cross sectional view showing how two constituent portions are combined to form a yoke.
Figure 4B:
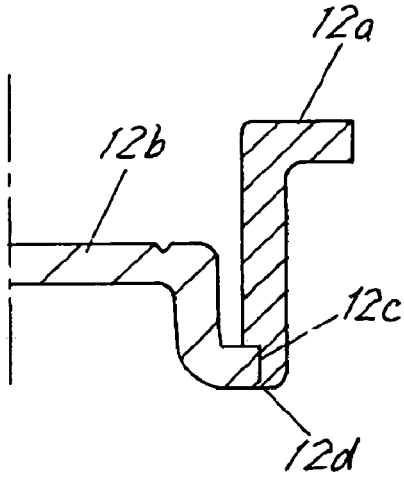
FIG. 4B is a cross sectional view of the finished yoke.

Since the cross sectional form of the yoke is as illustrated in FIGS. 4A, 4B, where the bottom 12*b* has a lift-up, it has been difficult to form it through a deep drawing process and to finish it with a plating layer having a uniform thickness.

In the present embodiment, the outer cylindrical portion 12*a* is provided with a step 12*c* at the bottom end, and the bottom 12*b* is provided with a tapered portion 12*e* at the edge of the outer circumference, as shown in FIGS. 4A, 4B.

The yoke 12 is assembled into one component by fitting the circumference edge of the disk-shaped bottom 12*b*, which has a lift-up portion in the center, to the step 12*c*, and fixing the bottom 12*b* by surrounding it with an edge of the bottom rim 12*d* of the outer cylindrical portion 12*a* by a caulking process.

The caulking of the bottom rim 12*d* of the outer cylindrical portion is conducted along the contour of the tapered portion 12*e*. Therefore, the caulking can be performed easily in a reliable manner. Furthermore, edge of the bottom rim 12*d* is not folded as far as a right angle in the caulking operation, which contributes to prevent deterioration in the caulking strength.

Figure 5:
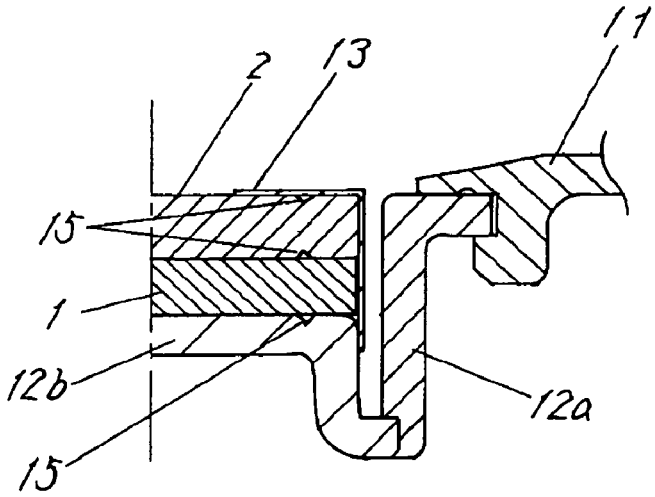
FIG. 5 is a cross sectional view of a magnetic circuit of still another loudspeaker in accordance with the first exemplary embodiment of the present invention.
Figure 6:
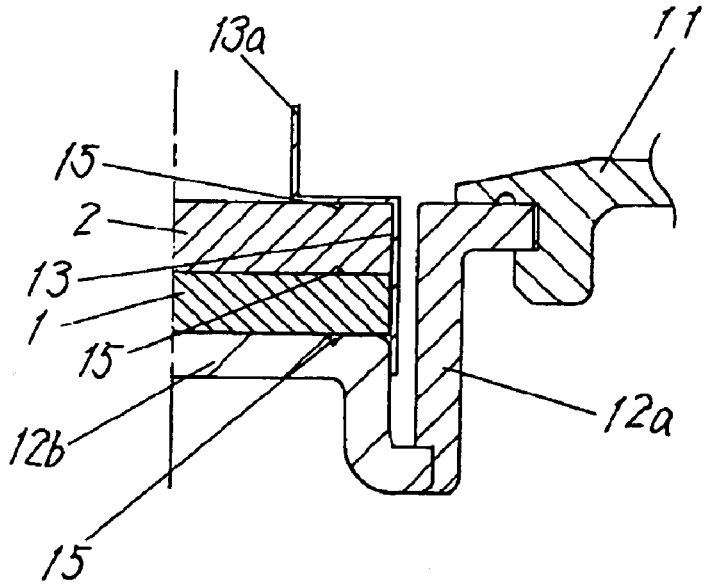
FIG. 6 is a cross sectional view of a magnetic circuit of still another loudspeaker in accordance with the first exemplary embodiment of the present invention.
Figure 7:
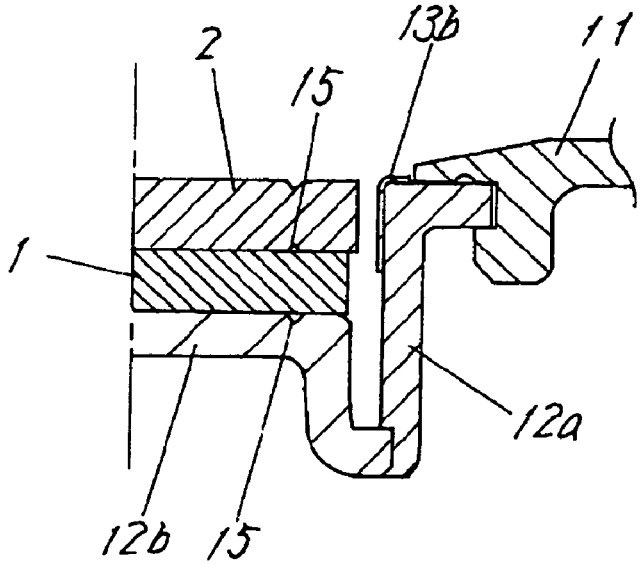
FIG. 7 is a cross sectional view of a magnetic circuit of still another loudspeaker in accordance with the first exemplary embodiment of the present invention.

FIG. 5 through FIG. 7 illustrate further application samples of the present embodiment, which aim to enhance heat radiation effects. As shown in FIG. 5 through FIG. 7, the magnetic circuit is provided with a copper cap 13 disposed so as to make contact with the bottom 12*b* of the yoke 12. This is intended to transfer heat from the voice coil 14 to the yoke 12.

Referring to FIG. 6, a heat radiator 13*a* attached to the copper cap 13 is aimed to dissipate the heat to a space within the voice coil 14. In FIG. 7, a copper ring 13*b* provided on the outer cylindrical portion 12*a* is aimed to transfer the heat generated at the voice coil 14 to the yoke 12 (12*a*, 12*b*). The heat radiation effect of the copper cap 13 (13*b*) contributes to provide loudspeakers that can withstand high input power.

A groove 15 provided along the outer circumference of the top plate 2 and the yoke bottom 12*b* is a reservoir for preventing an adhesive material for bonding the top plate 2, the yoke bottom 12*b* and the magnet 1 from squeezing out to the side face.

A loudspeaker of the present embodiment is provided with an air ventilation hole 14*a* in the voice coil 14. Air within the voice coil 14 can move to a space 8*b* formed by a damper 8 when the air is compressed as a result of a movement of the voice coil 14. This reduces a resistance of airflow, and contributes to improve the response characteristic of a loudspeaker during reproduction of low frequency range sounds, when the amplitude becomes great. This also prevents the heat generated at voice coil 14 from staying within the voice coil 14. When the air ventilation hole 14*a* is disposed at a certain specific location so that it is concealed inside the magnetic gap at a time of great amplitude with the voice coil 14, the airflow resistance at that stage gets a sudden increase. Such a configuration can be used as an air brake for preventing the voice coil 14 from colliding with the yoke bottom 12*b*.

Second Embodiment

A loudspeaker in accordance with a second exemplary embodiment of the present invention is described with reference to FIGS. 8A, 8B and 8C.

Figure 8A:
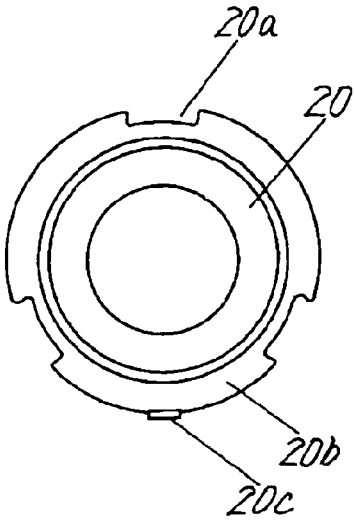
FIG. 8A is a bottom view of a yoke of a loudspeaker in accordance with a second exemplary embodiment of the present invention.
Figure 8B:
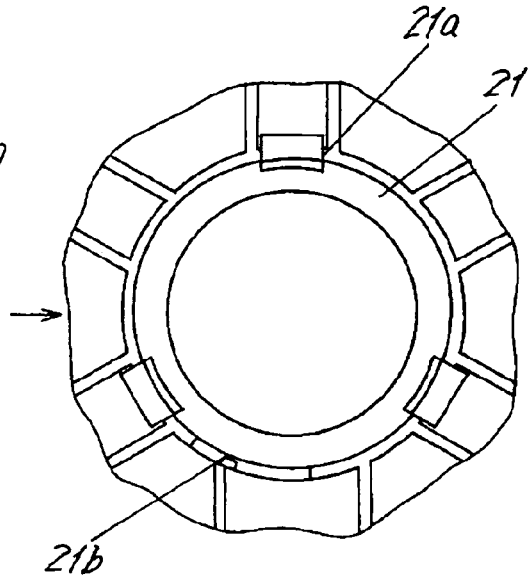
FIG. 8B is a bottom view of a frame.

As shown in FIG. 8A, a loudspeaker of the present embodiment comprises a yoke 20 made of a metal, three cuts 20*a* provided at outer circumference of the yoke 20, three expansions 20*b*, and a protrusion 20*c* protruding outward from the expansion 20*b*. In addition, a single expansion 21*b* could be used. A plastic frame 21 is provided, as shown in FIG. 8B, with three clip sections 21*a* for coupling with the cuts 20*a*, and a recess 21*b* for engagement with the protrusion 20*c*. In addition, a single clip section 21*a* could be used.

Figure 8C:
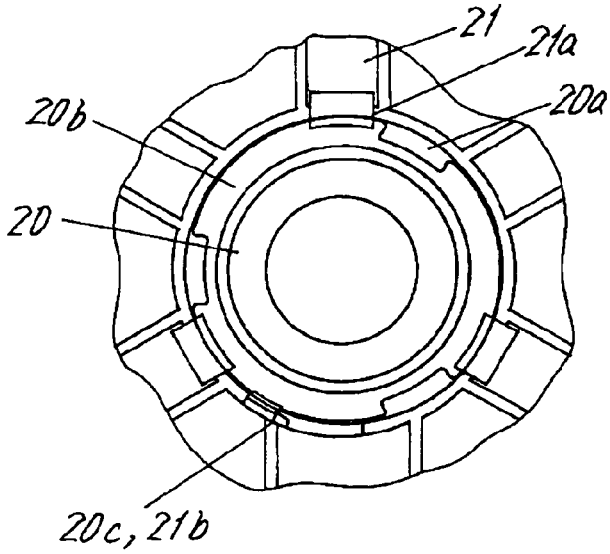
FIG. 8C is a bottom view showing a state when the yoke and the frame are coupled.
Figure 9:
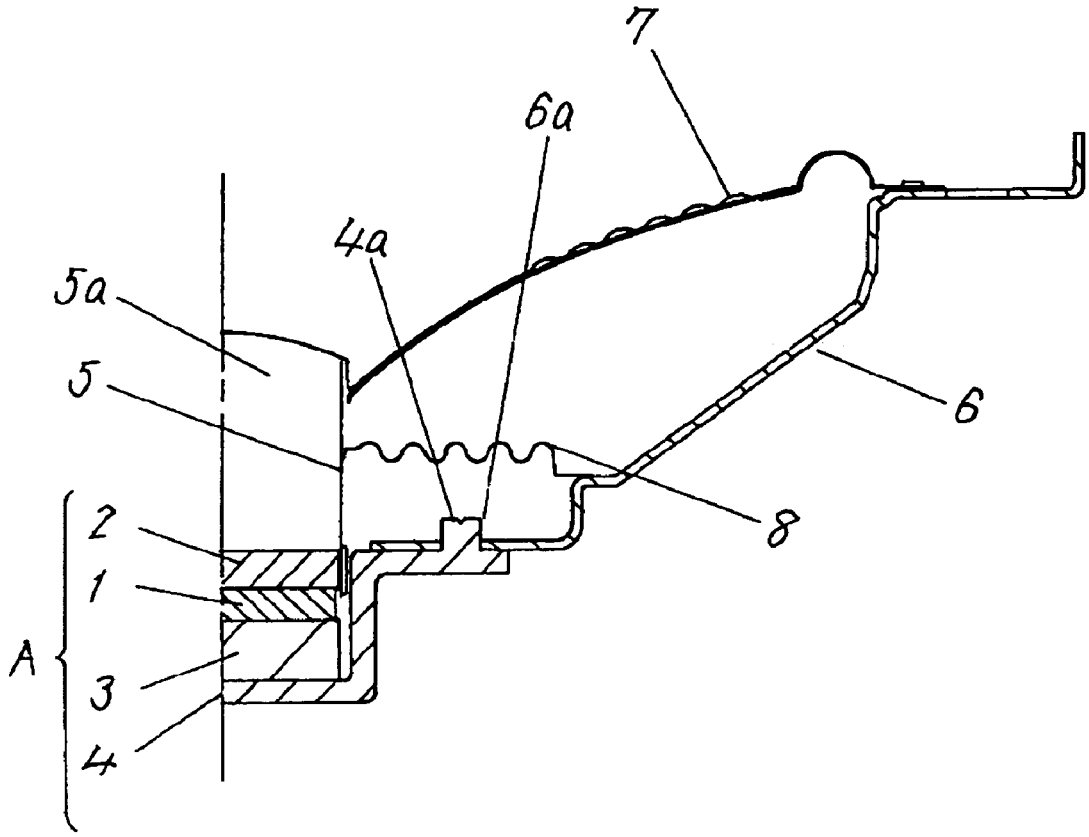
FIG.9 Prior Art
FIG. 9 is a cross sectional view showing in the half portion of a conventional loudspeaker.

The above-configured yoke 20 and frame 21 are disposed so that the cuts 20*a* are placed to be fitted to a location corresponding to the clip sections 21*a*, and then the yoke 20 is revolved so that expansions 20*b* are under the clip sections 21*a*, as shown in FIG. 8C. Thus, the yoke 20 is now prevented falling off from the frame 21. As a result of revolution of the yoke 20, the protrusion 20*c* drops into the recess 21*b*, which works as a stopper. The expansions 20*b* are kept retained under the clip sections 21*a*, and the yoke 20 does not leave the frame 21. If the clip section 21*a* is provided with a slightly tapered portion pressed against the expansion 20*b*, the clip section 21*a* and the expansion 20*b* can be brought into an engagement state of compression coupling. In such a configuration, the above-described stopper can be eliminated.

As shown in FIG. 8A, a loudspeaker of the present embodiment comprises a yoke 20 made of a metal, three cuts (slots) 20*a* provided at outer circumference of the yoke 20, three expansions 20*b*, and a protrusion 20*c* protruding outward from the expansions 20*b*. A plastic frame 21 is provided, as shown in FIG. 8B, with three clip sections 21*a* for coupling with the cuts 20*a*, and a recess 21*b* for engagement with the protrusion 20*c*.

Although the number of cuts 20*a* and the corresponding clip sections 21*a* has been described to be three in the above descriptions, the number is not limited to three. These elements may be provided in an appropriate number, depending on the overall shape and the dimensions of loudspeakers.

In order to provide improved heat radiation, such schemes as shown in FIGS. 5–7 used in the loudspeakers in the first embodiment may, of course, be also introduced to those loudspeakers in the present embodiment.

In the descriptions of the above embodiments of the present invention, a loudspeaker having an inner magnetic type magnetic circuit has mostly been used as an example, where an expensive neodymium magnet is used. The present invention, however, is also applicable to a loudspeaker having an outer magnet type magnetic circuit, by replacing a yoke in the above description with a top plate of an outer magnet type magnetic circuit.

As described above, a frame and a yoke can be easily connected together in a loudspeaker of the present invention, despite the compact and small magnetic circuit thereof. Thus, the present invention brings about a significant advantage in the industry.

What is claimed is:

1. A loudspeaker comprising:

a magnetic circuit having a yoke and a magnetic gap;

a frame having a plurality of clip sections;

a voice coil inserted in the magnetic gap of said magnetic circuit; and a diaphragm connected to said voice coil, wherein said yoke has an expansion provided at an outer circumference of said yoke, said expansion extending outward from said yoke, a plurality of slots are provided at an outer circumference of said expansion, said plurality of slots having positions on the expansion that are alignable with positions of said plurality of clip sections on said frame, and said expansion and said plurality of clip sections are adapted to revolve with respect to each other to couple said magnetic circuit and said frame.

2. The loudspeaker of claim 1, wherein said yoke has at least one additional expansion for coupling said magnetic circuit and said frame.

3. The loudspeaker of claim 1, wherein said frame is made of plastic.

4. The loudspeaker of claim 1, wherein said yoke comprises an outer cylindrical portion and a bottom portion, wherein said bottom portion is fitted to said outer cylindrical portion at a step provided at said outer cylindrical portion.

5. The loudspeaker of claim 4, wherein said yoke is formed by caulking a bottom end of said outer cylindrical portion around a tapered part provided at an edge of an outer circumference of said bottom portion.

6. The loudspeaker of claim 4, wherein said bottom portion of said yoke has a lift-up at a central part of said yoke, a magnet, and a plate overlaid on said bottom portion.

7. The loudspeaker of claim 1, wherein said magnetic circuit is an inner magnet type magnetic circuit comprising said yoke, a magnet and a plate, said magnet and said plate being overlaid in a central part of said yoke.

8. The loudspeaker of claim 1, wherein said magnetic circuit further comprises a heat radiator.

9. The loudspeaker of claim 8, wherein said heat radiator is a cap made of copper material disposed so that an end of said cap makes contact with a bottom portion of said yoke in said magnetic circuit.

10. The loudspeaker of claim 8, wherein said heat radiator is a cap made of copper material having a protrusion protruding into a space of said voice coil.

11. The loudspeaker of claim 8, wherein said heat radiator is a ring made of copper material attached to an outer cylindrical portion of said yoke.

12. The loudspeaker of claim 1, wherein said yoke further comprises a protrusion formed on said expansion, and said frame is provided with a recess for engagement with said protrusion.

13. The loudspeaker of claim 1, wherein at least an outer circumferential portion of said yoke is exposed and extruding from said frame.

14. The loudspeaker of claim 1, wherein said voice coil has a cap and a perforation provided at a location of said voice coil lower than a level where a damper is connected.

15. The loudspeaker of claim 14, wherein the perforation sinks into the magnetic gap when said diaphragm vibrates.

16. The loudspeaker of claim 1, wherein a bottom portion of said yoke has a groove at an outer circumference.

17. The loudspeaker of claim 1, wherein said clip sections further comprise a tapered portion for coupling with said expansion.

* * * * *